US005279436A

United States Patent [19]

Elliott et al.

[11] Patent Number: 5,279,436

[45] Date of Patent: Jan. 18, 1994

[54] KNOCK DOWN SHIPPING CONTAINER USING BUILDING COMPONENTS

[75] Inventors: Stewart S. Elliott, Chelsea; John S. Barrie, Ann Arbor, both of Mich.

[73] Assignee: Tecco, Ltd., Ann Arbor, Mich.

[21] Appl. No.: 913,625

[22] Filed: Jul. 16, 1992

[51] Int. Cl.[5] ..... B65D 81/36; B65D 88/10

[52] U.S. Cl. ..... 220/1.5; 52/143; 52/815; 52/827; 206/321; 220/4.01; 220/4.33

[58] Field of Search ..... 52/79.5, 125.2, 143, 52/815, 817, 827; 206/321, 524.3; 217/12; 220/4.01, 4.28, 4.29, 4.33, 4.34, 468, 1.5

[56] References Cited

U.S. PATENT DOCUMENTS

| | | | |
|---|---|---|---|
| 1,828,684 | 10/1931 | Scarlett | 220/4.28 |
| 2,017,161 | 10/1935 | Pennock et al. | 217/12 R |
| 2,774,503 | 12/1956 | Moore | 220/4.33 |
| 2,920,781 | 1/1960 | Butcher et al. | 217/12 R |
| 2,922,517 | 1/1960 | Nordquist et al. | 217/12 R |
| 3,015,407 | 1/1962 | Fesmire et al. | 220/1.5 |
| 3,128,897 | 4/1964 | Wilkins | 220/1.5 |
| 3,387,733 | 6/1968 | Field . | |
| 3,421,268 | 1/1969 | Reynolds et al. . | |
| 3,456,830 | 7/1969 | Golder | 220/1.5 |
| 3,857,540 | 12/1974 | Ecker | 220/4.28 |
| 3,968,895 | 7/1976 | Barnes, Jr. et al. | 220/1.5 |
| 4,637,179 | 1/1987 | Begelow, Jr. et al. . | |
| 4,640,412 | 2/1987 | Skvaril . | |
| 4,807,808 | 2/1989 | Reed | 220/4.28 |
| 4,836,395 | 6/1989 | Goutille | 220/1.5 |
| 4,858,779 | 8/1989 | Zimmerlund | 220/1.5 |
| 5,031,792 | 7/1991 | Russo, Sr. | 220/403 |

FOREIGN PATENT DOCUMENTS

| | | | |
|---|---|---|---|
| 2216882 | 10/1989 | United Kingdom | 220/4.28 |

*Primary Examiner*—Jimmy G. Foster

*Attorney, Agent, or Firm*—Harness, Dickey & Pierce

[57] ABSTRACT

A knock down shipping container is provided with the walls of the container constructed of composite panels that are usable as exterior sheathing in building construction at the point of destination of the shipped goods. The container is assembled with a plurality of bolts as well as four upright corner posts formed by a pair of steel angle brackets, an inner bracket containing a plurality of threaded studs extending through the walls of the container and an outer bracket where tamper resistant nuts are threaded onto the studs connecting the inner and outer brackets together and thereby attaching the side walls together at the upright corners of the shipping container. The outer brackets include upper and lower standard corner fittings for use in stacking multiple containers and in securing the containers to a shipping vessel. Once the container reaches its destination, the container may be disassembled with the outer brackets of the corner posts being returned to the shipper for reuse while the panels forming the container walls can be used at the destination as building materials, thus eliminating the need for return shipment or storage of an empty container.

16 Claims, 3 Drawing Sheets

KNOCK DOWN SHIPPING CONTAINER USING BUILDING COMPONENTS

BACKGROUND AND SUMMARY OF THE INVENTION

The present invention relates to a knock down shipping container made of panels usable at the shipping destination in building construction and in particular to the corner posts used to attach adjacent upright walls of the shipping container to one another and to form vertical columns for stacking of multiple containers.

Large shipping containers of lengths between 20 and 53 feet are commonly used for long distance shipping of goods by truck, rail, boat or airplane. Such shipping containers provide for relatively easy handling of the goods during shipping and have resulted in the development of standard size containers. The containers have been developed with standard features for attaching multiple stacked containers and for anchoring the containers to a shipping vessel. One disadvantage in the use of shipping containers is the return shipment of empty containers or the storage of empty containers at the shipping destination until the container is needed. Furthermore, typical metal shipping containers weigh several thousand pounds which significantly adds to the total weight of the shipment.

It is an object of the present invention to provide a knock down shipping container that can be disassembled at the shipping destination to avoid storage or return of empty containers.

It is a feature of the shipping container of the present invention that the walls of the container are constructed of panels that can be readily used as a building material at the shipping destination.

It is a further feature of the shipping container of the present invention that the side wall panels are of a light weight composite construction significantly reducing the weight of the shipping container of this invention by approximately one third the weight of a comparable sized conventional container.

The shipping container of this invention is constructed of a plurality of composite panels with several panels joined together to form walls of the container which are larger than the individual panels. The container includes bottom and top walls, two upright side walls and two upright end walls which are joined together at their edges to form a generally rectangular prism shaped shipping container. At the four upright corners where the side walls are joined to the end walls, corner posts are used to join the walls and to form vertical columns for supporting container stacking loads. The corner posts include inner and outer brackets which are joined together by connectors extending through the side and end walls. At the top and bottom of each of the corner posts, the outer brackets include corner fittings. In a preferred embodiment, the corner fittings are ISO specified fittings for securing multiple stacked containers to one another and in securing containers to a shipping vessel as well as to facilitate intermodal handling during shipment.

In a preferred embodiment, the composite panels are formed of inner and outer skins of wood sheets such as oriented strand board (OSB) with a core of expanded polystyrene (EPS) or other rigid foam for a light weight container. At the edges of each panel, a portion of the EPS core is removed and a wood core is inserted to provide strength to the panel and to protect the EPS core. The panels are connected together with fasteners extending through the solid wood cores at the panel edges. Such a composite panel can readily be used in building construction, providing a strong structure and a well insulated sheathing for the exterior of a building.

Further objects, features and advantages of the invention will become apparent from a consideration of the following description and the appended claims when taken in connection with the accompanying drawings.

DETAILED DESCRIPTION OF THE INVENTION

Figure 1:
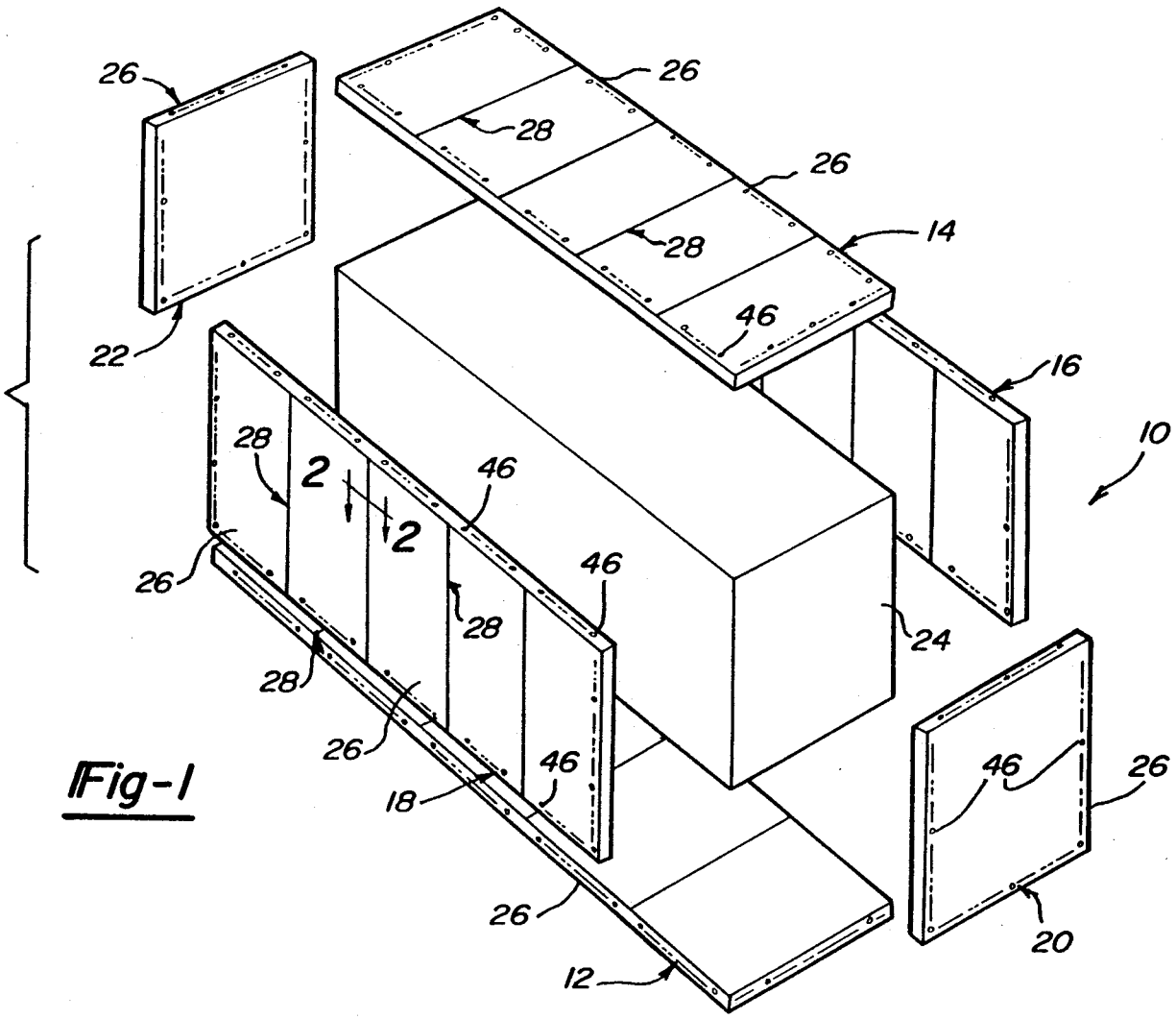
FIG. 1 is an exploded perspective view of the shipping container of the present invention.

The light weight knock down shipping container of the present invention is shown in the exploded perspective view of FIG. 1 and designated generally at 10. Shipping container 10 includes a floor or bottom wall 12, a ceiling or top wall 14, upright side walls 16 and 18 and end walls 20 and 22. The container 10 is shown surrounding cargo 24. The end walls of the container 20 and 22 are formed of a single composite panel 26 while the top, bottom and side walls are formed of a plurality of composite panels 26 joined together by spline joints 28 to form the walls.

Figure 2:
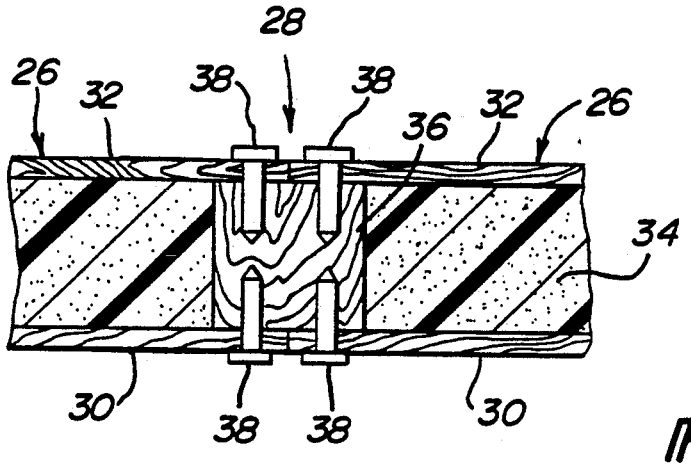
FIG. 2 is a sectional view of a spline joint between adjacent panels in a container wall as seen from substantially the line 2—2 of FIG. 1.

FIG. 2 is a sectional view through a spline joint 28 used to join adjacent panels 26 to form the container walls. In a preferred embodiment of the invention, the composite panels 26 are formed of outer and inner skins 30 and 32 respectively of a wood sheet such as oriented strand board with a core 34 of rigid foam such as expanded polystyrene (EPS) between the skins. Such a composite panel is used as a sheathing material for frame houses or commercial structures. Other materials can be used in forming the composite panels if desired. At the edge of each panel, a portion of the EPS core is removed and a solid wood board 36 of laminated veneer lumber or other wood product is inserted to cover and protect the EPS core and provide strength to the panels.

The spline joints 28 are of a tongue and groove nature in which one panel 26 is formed with the wood board 36 extending beyond the periphery of the outer and inner skins 30 and 32 while the adjacent board has a groove or recess formed between the inner and outer skins by removal of a portion of the EPS core. The board 36 is secured to the skins of both panels by a plurality of nails 38 and glue thereby forming a rigid connection between adjacent panels used to form the top, bottom and side walls of the container.

Figure 3:
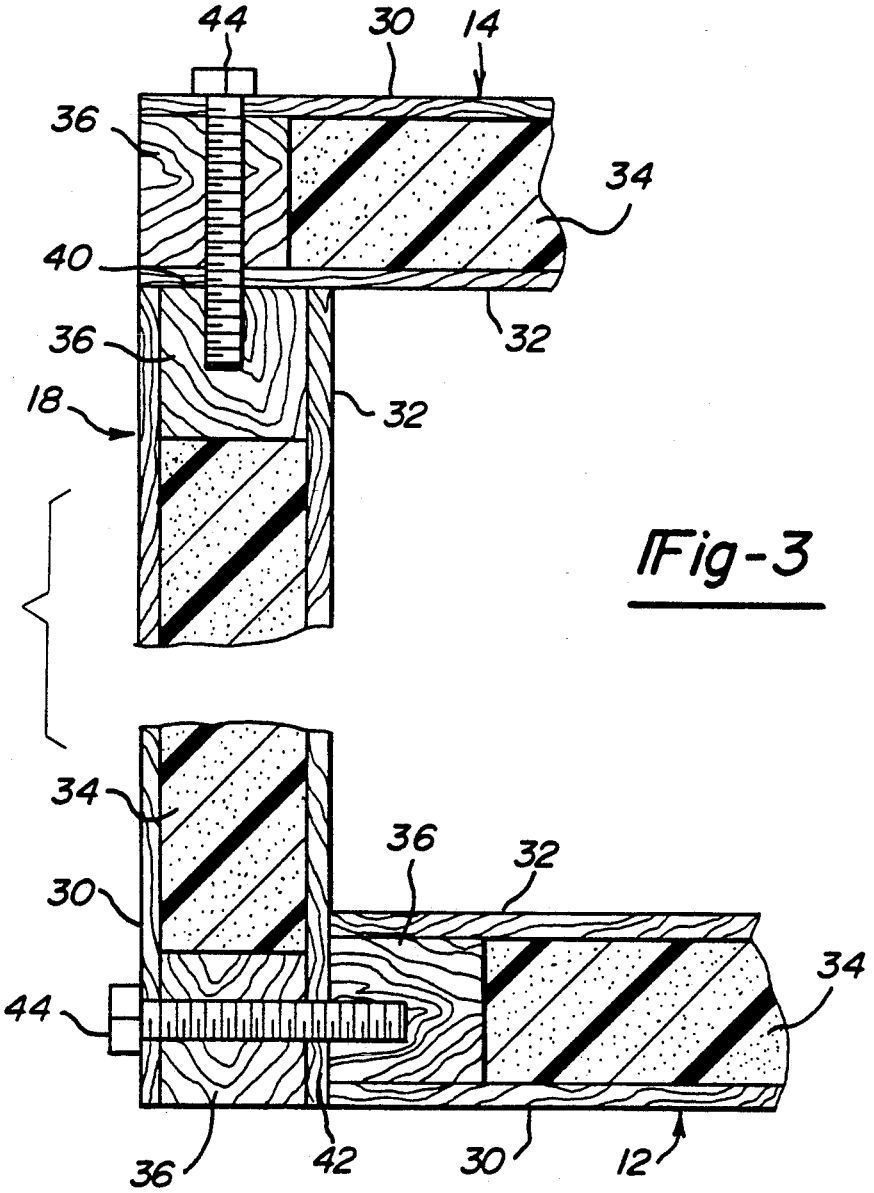
FIG. 3 is an enlarged vertical sectional view of a portion of the top, side and bottom walls of the shipping container of the present invention.

FIG. 3 is an enlarged vertical sectional view through the shipping container of the present invention showing the container construction in greater detail. The top wall 14 is positioned on top of and covers the upper edges 40 of the side walls. This provides a top wall surface extending to the sides of the container to prevent leakage into the container. This arrangement also aids in assembly of the container as described below. The side walls 16 and 18 overlie and cover the edges 42 of the bottom wall 12. A plurality of bolts 44 are used to fasten the side walls to the bottom wall and the top wall to the side walls as shown in FIG. 3 with the bolts passing through holes 46 as shown on FIG. 1.

The shipping container 10 can be assembled around the goods to be shipped. The goods are placed on top of the bottom wall 12 with the side walls and top wall assembled around the goods. The side walls 16 and 18 cover the edges of the bottom wall 12 so that the bolts 44 can be inserted horizontally through the side walls and into the bottom wall. The top wall is placed onto and is supported by the side walls with the bolts 44 projecting downward through the top wall and into the top edges of the side and end walls. The bolts extend through and into the solid wood core at the panel edges. When assembled, the top, bottom and side walls of the shipping container form a closed box beam.

Figure 4:
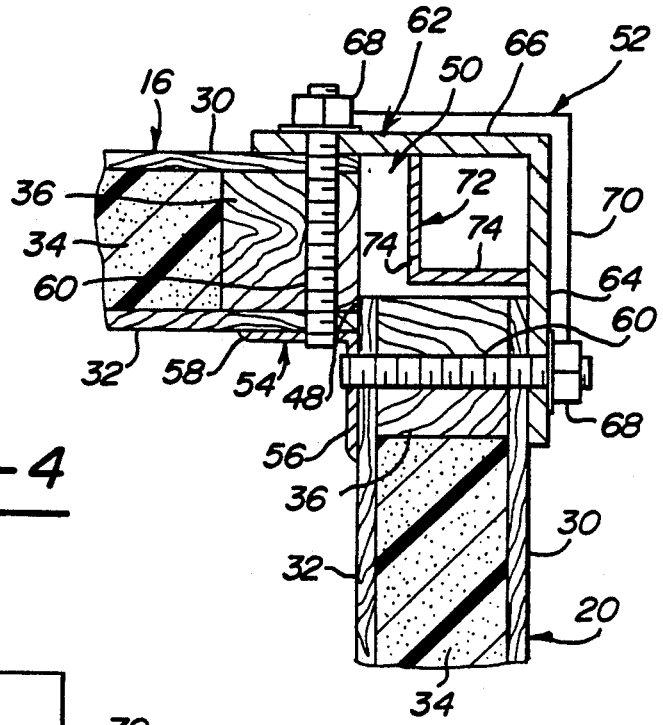
FIG. 4 is a horizontal sectional view of an upright corner of the shipping container of the present invention.

The horizontal sectional view of FIG. 4 illustrates the structure of the corner posts of the shipping container where the end walls 20 and 22 are joined to the side walls 16 and 18. At the vertical edges of the end and side walls, the cores are formed with solid wood.

Each upright corner post 52 is formed by an inner bracket 54 comprising a steel angle with plates 56 and 58 at a right angle to one another with plate 56 engaging the inner surface of the end wall 20 while plate 58 engages the inner surface of the side wall 16. A plurality of threaded studs 60 are attached to the inner bracket 54 and extend through the side and end walls. An outer bracket 62 is formed of a pair of right angle plates 64 and 66 which overlie the end wall 20 and side wall 16 respectively and through which the studs 60 extend. Nuts 68 are threaded onto the ends of the studs, thereby coupling the inner and outer brackets together and attaching the end wall 20 to the side wall 16. The inner and outer brackets can be made of steel, aluminum, titanium or other metal providing the necessary strength as described below. The end and side walls are positioned so that an envelope defined by the end and side walls and the outer bracket 62 forms a hollow space 50 within the corner post.

Figure 5:
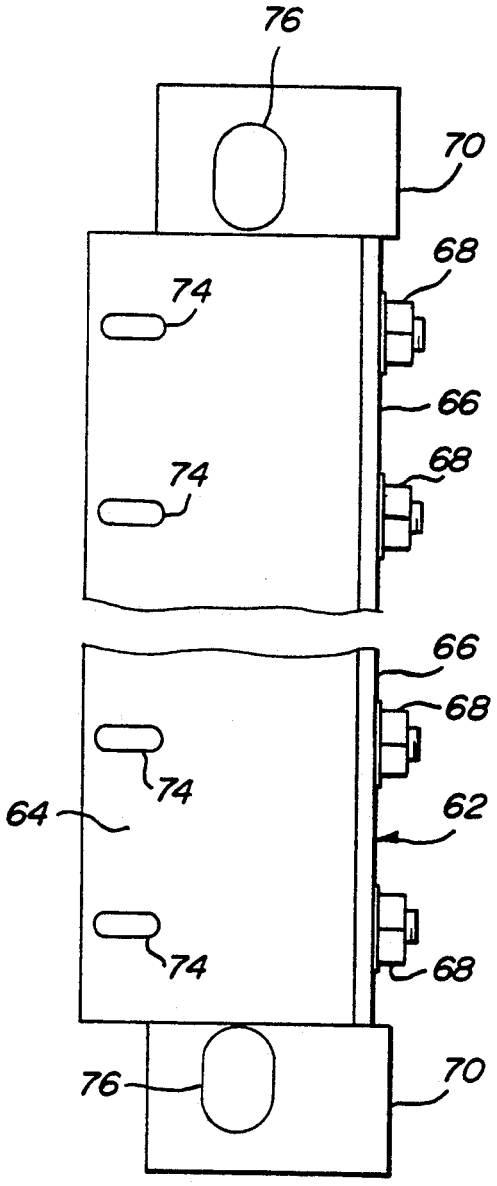
FIG. 5 is a side elevational view of an outer corner bracket of the shipping container of the present invention.

At its upper and lower ends, the outer bracket 62 is formed with corner fittings 70 which conform to international standards for shipping containers to facilitate the handling, stacking and locking of containers to one another and to the shipping vessel in which the containers are transported. The containers are supported on the corner fittings 70. With stacked containers, the weight of the upper container is carried by the upright corner posts 52 of the lower container. As a result, it is necessary for the corner posts to be capable of supporting high column loads. To provide the necessary column strength, the outer bracket 62 is strengthened by a reinforcing bracket 72 within the hollow interior 50 of each corner post. The reinforcing bracket 72 is in the form of a steel angle having a pair of plates 74 each welded to one of the plates 64 and 66 of the outer bracket, forming a closed box column with the outer bracket 62 for supporting the vertical load. A side elevational view of the outer bracket 62 is shown in FIG. 5. Plates 64 and 66 of the outer bracket 62 are formed with slotted openings 74 through which the studs 60 extend and are secured with nuts 68.

The standard corner fittings 70 are formed with a large opening 76 on the two outer sides and in the top or bottom walls for use in inserting locking pins in a well known manner for securing shipping containers.

Because the shipping container can be readily disassembled by removing several nuts or bolts, the nut and bolt heads are preferably of an uncommon shape to provide an element of tamper resistance to the shipping container.

The shipping container of the present invention, being formed of composite panels having a rigid insulating foam core, provides a significant weight reduction as compared to a conventional metal shipping container. For comparable sized containers, the container of the present invention weighs approximately two thirds the weight of a conventional container. Thus, significant weight savings can be achieved by use of this shipping container.

Once the goods have reached their destination, the shipping container is disassembled with the outer brackets 62 of the corner posts preferably being returned for reuse in other shipping containers. The top, bottom and side walls are disassembled with the individual walls being usable as exterior sheathing in building construction. The expanded polystyrene core provides the exterior sheathing with excellent insulating properties. In the event that the goods are to be stored at their destination before use, it is possible for the outer brackets of the corner posts to be removed and the attaching nuts replaced on the studs so that the goods can remain in the shipping container after the outer brackets have been returned for reuse.

It is to be understood that the invention is not limited to the exact construction illustrated and described above, but that various changes and modifications may be made without departing from the spirit and scope of the invention as defined in the following claims.

We claim:

1. A shipping container comprising:

spaced rectangular top and bottom walls;

upright side walls and end walls extending between said top and bottom walls;

means for releasably attaching said side walls and end walls to said top and bottom walls;

upright corner posts for joining said side walls to said end walls, each corner post including an outer bracket having a first plate engaging an outer surface of one side wall and a second plate engaging an outer surface of an adjacent end wall and a reinforcing bracket joined to said first and second plates forming together with said first and second plates of each outer bracket a hollow vertical column at the corners of said shipping container; and means for joining each said outer bracket to said one side wall and said adjacent end wall whereby said one side wall and said adjacent end wall are joined together, said joining means being selectively releasable to disassemble said shipping container by removing said outer brackets.

2. The shipping container of claim 1 wherein each said corner post further includes an inner bracket engaging an inner surface of said side wall and an inner surface of said adjacent end wall, said inner and outer brackets each include first plates in surface to surface engagement with said one side wall and second plates in surface to surface engagement with said adjacent end wall and said joining means extending through said one side wall and said adjacent end wall to join said first plates of said inner and outer brackets and said joining means extending through said adjacent end wall to join said second plates of said inner and outer brackets.

3. The shipping container of claim 1 wherein said outer brackets each include, at the upper and lower ends thereof, corner fittings extending below and above said bottom and top walls respectively for use in securing said shipping container to a shipping vessel and for securing, vertically stacked shipping containers to one another with the weight of one said container being supported by the outer brackets of the container therebelow.

4. The shipping container of claim 1 wherein said joining means includes, for each corner post, threaded studs mounted to said inner bracket and extending outwardly through said side and end walls and said outer bracket with nuts threaded onto said studs to couple said inner and outer brackets together.

5. The shipping container of claim 1 wherein said reinforcing bracket is a steel angle having first and second plates normal to one another and welded to said first and second plate of said outer bracket.

6. A shipping container comprising:

spaced rectangular top and bottom walls;

upright side walls and end walls extending between said top and bottom walls;

means for releasably attaching said side walls and end walls to said top and bottom walls;

upright corner posts for joining said side walls to said end walls, each corner post being formed by an outer bracket having a first plate engaging an outer surface of one of said side walls and a second plate engaging an outer surface of an adjacent end wall and a reinforcing bracket joined to said first and second plates forming together with said first and second plates of each outer bracket a hollow vertical column at the corners of said shipping container; and joining means for joining each said outer bracket to said side wall and said adjacent end wall whereby said one side wall and said adjacent end wall are joined together, said joining means being selectively releasable to disassemble said corner structure by removing said outer bracket;

said walls being of a composite structure of an outer skin, an inner skin and a core therebetween.

7. The shipping container of claim 6 wherein said walls are formed with cores of rigid foam and skins of wood sheets.

8. The shipping container of claim 7 wherein at the edges of said walls said cores are formed with wood boards.

9. The shipping container of claim 7 wherein said side and end walls surround the edge of said bottom wall and are fastened to said bottom wall by a plurality of bolts extending horizontally through said side walls and into said bottom wall, and said top wall overlies said side and end walls and is fastened to said side and end walls by a plurality of bolts extending vertically through said top wall and into said side and end walls.

10. The shipping container of claim 6 wherein at least one wall of said shipping container is made of a plurality of separate composite panels each having inner and outer skins and cores therebetween with said panels being joined together at adjacent edges to form said at least one wall.

11. The shipping container of claim 10 wherein said panels are joined together in a tongue and groove spline connection with a groove being formed between said inner and outer skins of one panel by removal of a portion of said core and said tongue being formed by a wood board core extending beyond the edge of the adjacent panel for insertion into said groove and a plurality of nails extending through the skins and wood board to join said panels together.

12. A shipping container comprising:

spaced rectangular top and bottom walls;

upright side and end walls extending between said top and bottom walls at peripheries of said top and bottom walls defining an interior cargo space; and means for joining said top and bottom walls to said side and end walls and for joining said end walls to said side walls, said joining means including upright column structures at the four vertical corners formed by said side and end walls, said column structures extending upward above said top wall and downward below said bottom wall whereby a plurality of said containers can be stacked one upon another with the column structures of one container being supported upon the column structures of the container, each upright column structure including an outer bracket having a first plate engaging one of said side walls, a second plate engaging an adjacent end wall and a reinforcing bracket joined to said first and second plates forming together with said first and second plates of each outer bracket a hollow vertical column structure at each corner of said shipping container.

13. A shipping container of claim 12 wherein:

said walls are constructed of inner and outer wood sheets and cores of expanded polystyrene between said wood sheets with the cores of said walls at the edges of said walls being formed by solid wood boards.

14. The shipping container of claim 13 wherein said wood sheets are made of oriented strand board.

15. The shipping container of claim 13 wherein at least one of said walls is constructed of a plurality of composite panels each having inner and outer wood sheet skins and polystyrene cores with the core at the edges of each panel being of a wood board, said panels being joined together at adjacent edges to form said at least one wall.

16. The shipping container of claim 15 wherein said panels of said at least one wall are joined together in a tongue and groove spline connection with a groove being formed between said inner and outer skins of one panel by removal of a portion of said core and said tongue being formed by a solid wood board core extending beyond the edge of the adjacent panel for insertion into said groove and a plurality of nails extending through the skins and wood board to join said panels together.

* * * * *